United States Patent [19]

Leale

[11] Patent Number: 4,667,132

[45] Date of Patent: May 19, 1987

[54] ELECTRONIC TRANSFORMER SYSTEM FOR NEON LAMPS

[75] Inventor: Luis O. Leale, Houston, Tex.

[73] Assignee: DiAnalog Systems, Inc.

[21] Appl. No.: 835,644

[22] Filed: Mar. 3, 1986

[51] Int. Cl.[4] ..... H01F 27/30

[52] U.S. Cl. ..... 315/282; 315/278; 315/DIG. 7; 336/208

[58] Field of Search ..... 315/278, 282, DIG. 7; 331/113 A; 336/207, 208

[56] References Cited

U.S. PATENT DOCUMENTS

| | | | |
|---|---|---|---|
| 2,355,477 | 8/1944 | Stahl | 336/208 |
| 3,703,677 | 11/1972 | Farrow | 315/DIG. 7 |
| 4,187,450 | 2/1980 | Chen | 315/278 |
| 4,274,136 | 6/1981 | Onodera et al. | 336/208 |
| 4,414,491 | 11/1983 | Elliott | 331/113 A |
| 4,523,131 | 6/1985 | Zansky | 315/DIG. 7 |
| 4,547,705 | 10/1985 | Hirayama et al. | 315/278 |

*Primary Examiner*—Harold Dixon

[57] ABSTRACT

An electronic transformer system for operating neon lamps includes a converter coupled to a leakage reactance power transference transformer. The electronic transformer system may be energized by alternating current through a full wave rectifier, or by a direct current supply.

1 Claim, 20 Drawing Figures

ELECTRONIC TRANSFORMER SYSTEM FOR NEON LAMPS

BACKGROUND OF THE INVENTION

1. Field of the Invention

The neon lamp is a known illumination device formed of an evacuated glass tube confining an ionizable gas and a small amount of mercury, electron emitting cathodes, and having electrical terminals at each end. Upon application of the proper electrical voltage to the terminals, the gas becomes ionized and an electrical arc is established between the cathodes through the gas inside the tube, evidenced by the arc. Neon lamps emit different colors of light, according to the composition of the gas. Neon lamps find wide usage for advertising and display purposes because of the colorful illumination provided by the ionized neon gas.

As is known, the neon lamp is a peculiar type of electrical load which possesses a "negative resistance". That is, a given high voltage is required to start the lamp and, once started, a lesser voltage is required to sustain its operation.

Until the present, the only apparatus used in powering neon lamps is one which steps up the line voltage, to the higher starting voltage, by means of a bulky step-up transformer of the high leakage reactance type, in which the secondary winding is connected across the lamp to provide the high starting voltage and, once the lamp ignites, to limit current to "ballast" the lamp. This step-up transformer is fed directly by the low frequency line carrying commercial alternating current as provided by public utility companies. Commercially available power is normally provided at a frequency between 50 hertz to 60 hertz and a voltage between 110 to 120 volts.

Like any electro-magnetic device, a conventional transformer used to operate neon lamps is inherently noisy when operated from an alternating current of 60 hertz. The amount of noise varies to a degree dependent upon the size of the transformer, and the deterioration rate of the varnishes and insulator materials. The reason for the noise is that lamp voltage waveforms contain harmonic components ranging from 120 hertz up to 3,600 hertz and even higher. Therefore, the noise generated by conventional transformer systems for driving neon lamps varies from a low pitched hum to a high pitched "rustle". In conventional transformers noise is generated by vibration of the laminated transformer core and by stray magnetic fields which cause vibration of the transformer case or even the frame in which the transformer is mounted.

One further disadvantage of conventional neon lamp transformers is the large volume and weight of such devices. Because a neon lamp requires a very high starting voltage and a high operating voltage, the ballast impedance required to stabilize the negative impedance of this type of lamp is accomplished with a leakage reactance transformer. Such transformers are quite large and bulky, and frequently must be located some distance from the lamp frame. Also increasing the volume of this type of transformer is the high dielectric resistance material needed between the layers in the secondary winding because of the high voltage present.

Another disadvantage in the conventional neon lamp transformers is the $I^2R$ loss in the copper wires. This loss, as its name implies, is equal to the sum of the squares of the currents multiplied by the resistance of the various windings. As the currents are fixed by the rating, it is evidently impossible to reduce the values in order to reduce the $I^2R$ losses. In a conventional transformer, for example, to feed a load of 15,000 volts of neon lamps, the resistance in the secondary winding is about 18 K-ohms, and the current 0.028 Amps. Thus, the losses in the copper wire are $I^2R = 18{,}000 \times 0.028^2 = 14$ Watts.

One further loss is caused by the eddy currents in individual conductors which are set up by stray magnetic fields. The loss in these fields is directly proportional to the leakage fields and to the total weight of copper, two characteristics of this type of transformer.

Another important loss is the hysteresis loss in core plates. This loss is dependent upon the material of the core plates used and is proportional to the weight of material used. A heavy weight core is an inherent characteristic of this type of transformer.

The last important loss is the eddy current loss in core plates, also directly proportional to the volume of the core.

Important in sign display is animation, through intermittent flashing of sections of the lamps to attract attention. With the conventional transformer to operate neon lamps there are two ways to accomplish flashing. One of them is low voltage flashing and is accomplished in the primary circuit of the high voltage transformer. The other one is secondary flashing and is accomplished in the secondary circuit of the high voltage transformer.

In low voltage flashing, the contacts of the device used to accomplish that effect must handle all the current of the transformer, normally ranging from 2 Amps to more than 13 Amps, depending on the rated load of the transformers. This high current produces sparks between contacts, leading to short contact life and high maintenance cost. It also may result in faulty flashing as evidenced by the irregular operation of the flasher and may be accompanied by heavy arcing and radio interference.

The secondary flasher, on the other hand, has the disadvantages of requiring long high voltage cables from the flasher to each section of tubing and the difficulty of maintaining a high voltage flasher in good repair because of the high voltage arcing between the contacts.

SUMMARY OF THE INVENTION

The present invention is an electronic transformer system that includes a solid state inverter oscillator and a leakage reactance transformer which overcomes almost all problems associated with the conventional transformers, now used to power neon lamps. Specifically, unlike prior art, the leakage reactance power transformer employed in the transformer system of the present invention is not powered directly from commercially available 60 hertz alternating electrical current. Rather, an electronic inverter is interposed between the public utility lines and the leakage reactance transformer input.

The electronic inverter employed in the transformer system of the present invention drives the leakage reactance power transference transforemr primary winding at a much greater frequency than in conventional neon lamp transformers. The output frequency of the electronic inverter, and hence the frequency of the input to the power transference transformer can be between 15 kHz and 25 kHz. The harmonic components of the lamp voltage are therefore 30 kHz or greater. As a consequence, both the fundamental waveform in the primary of the ballast transformer, and the harmonics of that waveform lie beyond the audible range. As a result, the transformer system of the present invention operates with practically no noise.

Another characteristic of the present invention is that the electronic transformer has only a fraction of the weight of a conventional transformer for neon lamps. The large weight of the conventional transformer is mainly the heavy ferromagnetic core, and the copper that this type of transformer requires. This conventional transformer must be mounted in a large, heavy frame. The lighter weight of the transformer system of the present invention reduces the structural requirements for neon lamp fixture supports, thereby providing a considerable savings in the cost of construction of the frames and fixtures.

As is well known, neon lamps, like fluorescent lamps increase in efficiency at higher frequencies, giving the same light output with less energy consumption. Thus another feature of the present invention is greater efficiency in operation. The electronic transformer system of the invention provides the same light output as a conventional transformer saving up to 40% of the power required by such conventional transformer.

The National Electrical Code requires that all high voltage transformers be installed as close as practical to the lamps they operate to insure that the conductors from the transformer are as short as possible. When it is necessary for the secondary conductors to pass through a wall, special insulating sleeves of glass material must be provided around the conductor where is passes through any concealed space. The necessity for the provision of such special insulating sleeves frequently occurs in mounting conventional transformers because their larger size and weight require mounting at considerable distance from the neon lamps.

The transformer system of the present invention is ligther in weight and smaller in size than conventional transformers. The transformer system of the invention occupies only about one-third of the volume of a conventional transformer. As a result, it is very frequently possible to position the much smaller transformer system of the present invention inside of a lamp casing, whereas it would be impossible to do so with conventional transformers. As a result, the length of the secondary conductors of the electronic transformer system is greatly reduced, resulting in a very significant saving in installation costs. Furthermore, the very short length of the high voltage secondary output leads enhances the safety of the transformer system of the invention.

Another significant advantage of the present invention is that in the electronic transformer system the short circuited current steps down drastically. In conventional transformers for neon lamps, the short circuited current in the transformer secondary output ranges from 10 to 60 milliamps, which is greater than the current with the lamp load. As a result, in an accidental short circuit of lengthy duration, the conventional transformer will heat up and can be destroyed. In the transformer system of the present invention, the heating in the power transference transformer is minimum at short circuit condition.

Another feature of the present invention is that it can easily accomplish the flashing effect handling only a few milliamps of current, thus overcoming the troubles of conventional transformers with high current.

DESCRIPTION OF THE EMBODIMENTS

Figure 1:
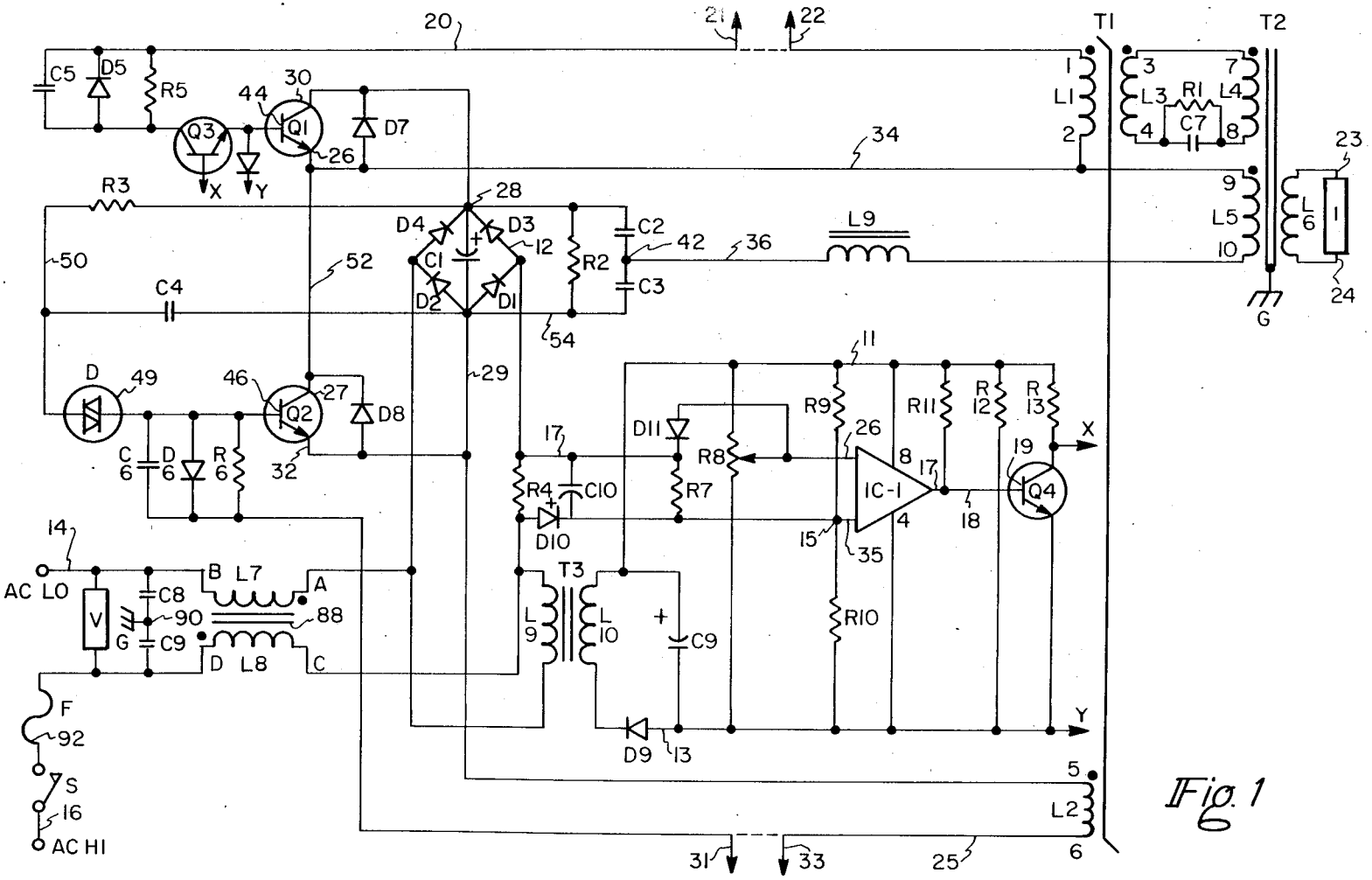
FIG. 1 is a schematic diagram of the electronic transformer system of the invention utilizing an alternating current input, and including the circuit to stop the oscillation when the output is open (without load) or is in a short-circuit condition.

FIG. 1 illustrates a solid state electronic transformer system designed to operate a conventional neon lamp 1. The electronic transformer system employs a full wave rectifying circuit 12 for receiving alternating current power as an input on alternating current (AC) lines 14 and 16. The rectifying circuit 12 provides direct current (DC) power as an output to a half-bridge inverter circuit, a secondary winding L6 which is coupled to neon lamp terminals 23 and 24, and a feedback winding L4. A pulse generator base driving transformer T1 has a primary winding L3 coupled in series to the feedback winding L4 of the leakage reactance power transference transformer T2. The secondary windings L1 and L2 of the pulse generator base driving transformer T1 cyclically drive the half-bridge inverter circuit to provide power to the primary winding L5 of the leakage reactance power transference transformer T2 alternatingly, and in opposite directions.

The half-bridge oscillator circuit has a first transistor Q1 and a second transistor Q2. The emitter 26 of the first transistor Q1 is coupled to the collector 27 of the second transistor Q2. A pair of direct current supply lines 28 and 29 is coupled, respectively, to the collector 30 of the first transistor Q1 and to the emitter 32 of the second transistor Q2. A pair of capacitors C2 and C3 is connected in series across the direct current supply lines 28 and 29. The half-bridge inverter has the same configuration as a bridge inverter, but the half-bridge inverter replaces two of the inverter transistors with two capacitors and, hence is more economical. The midpoint 46 of the capacitors charges up to an average potential of Vcc/2 and peak primary voltage is thus Vcc/2. A lead 34 connects the emitter 26 of the first transistor Q1 and the collector 27 of the second transistor Q2 to the primary winding L5 of the leakage reactance power transference transformer T2. A lead 36 is connected through inductance L9, from the other end of the primary winding L5 to the midpoint 42 of the capacitors C2 and C3.

The two series connected transistors Q1 and Q2 are driven in alternating sequence. The bases 44 and 46 of the transistors Q1 and Q2, respectively, are alternatively biased by oppositely wound secondary windings L1 and L2, respectively, of the pulse generator base driving transformer T1. The pulse generator base driving transformer T1 has a primary winding L3 and two output secondary windings L1 and L2. The primary winding L3 is coupled in a loop to the feedback winding L4, which is an additional secondary winding of the power transference transformer T2. A capacitor C7 and a resistor R1 are coupled in parallel with each other and in series with the primary winding L3 and the feedback winding L4 to control the duration of pulses provided to the counterphase oscillator circuit by the pulse generator base driving transformer T1.

In the embodiment depicted in FIG. 1, the base driving transformer T1 and two secondary output windings L1 and L2, each respectively connected in circuit between the emitter and the base of the associated one of the transistors Q1 and Q2. A diode D5, a capacitor C5 and a resistor R5 are connected in parallel to the base 46 of the transistor Q1, through transistor Q3 which has its collector connected to one end of the capacitor C5, diode D5 and resistor R5, and has its emitter connected to the base 44 of transistor Q1. The other end of the capacity C5, diode D5 and resistor R5 are connected to one lead of the secondary winding L1, and the other lead of the secondary winding L1 is connected to the emitter 26 of transistor Q1. Similarly, a diode D6, a capacitor C6 and a resistor R6 are connected in parallel to the base 46 of the transistor Q2 from one lead of the secondary winding L2 of the base driving transformer T1, and the emitter 32 of transistor Q2 is coupled to the other lead of the secondary winding L2.

The resistors R6 and R6 limit the current in the circuit emitter-base of each transistor Q1 and Q2 respectively, to a rate necessary to get the proper collector current corresponding to the lamp load and the transistor gain.

A bothersome problem in this type of inverter is the simultaneous transistor conduction. This problem arises from the possibility that at the moment the on-turning transistor receives its base turn-on signal, the off-turning one, although it has lost its base drive signal, still remains on because of collector storage time.

The base drive signals are square waves 180° out of phase. The transistions between high and low are exactly time coincident for the two inputs, but storage time in the turn-off transistor keeps the collector on at $V_{ce(sat)}$ of 1 volt for times of 1 to 5 microseconds, depending on the type of transistor. Since turn-on time is considerably shorter than storage time, until the end of the storage interval both transistors are simultaneously on.

This can lead to catastrophic failure, for as long as the off-turning transistor is in storage, it keeps a voltage Vcc/2 across the primary winding L5. By transformer action, the opposite collector is held to a potential of Vcc and cannot begin moving down to saturation. But since this transistor has received a base turn-on signal at the start of the storage of the opposite device, it carries a very high current (about $BI_b$) at a collector voltage of $V_{cc}$. This spike of high dissipation occurs once each full cycle for each transistor. At a duty cycle that is high enough, the average power can raise the junction temperature to the failure point. This average dissipation per transistor is $PD = V_{cc}BI_bf_ot_s$, where $f_o$ is the square wave frequency and $t_s$ is the storage time. Even if the average power is not sufficient to destroy the transistor, secondary breakdown effects may destroy it.

The obvious way to avoid simultaneous conduction is either to reduce the storage time holding the turn-off transistor on too long or to delay the turn-on of the turn-on device.

In the present invention, a simple and inexpensive means to delay turn-on is included. Capacitors C4 and C6 are added to integrate and delay the positive-going turn edge of the square wave input signals. The resistors R5 and R6 are paralleled by diodes D5 and D6 in the polarity shown. For positive-going inputs, they are reverse biased and effectively out of the circuit. For negative-going signals, resistors R5 and R6 are shunted by forwarded-biased diodes D5 and D6, which quickly discharge C5 and C6 and draw large reverse currents from the turn-off base.

The full wave rectifying bridge 12 employing diodes D1, D2, D3 and D4 and a filtering capacitor C1, is coupled to the commercially available 60 hertz alternating current electrical supply lines 14 and 16. A resistor R3 is coupled to the positive end of the rectifying bridge 12 and the capacitor C4 is coupled to the negative end of the rectifying bridge 12. A diac 49 serves as an active element of the oscillator starting circuit and is coupled to the junction between the resistor R3 and capacitor C4 and to the base 46 of the transistor Q2.

The starting circuit for the half-bridge oscillator circuit is formed of the resistor R3, the capacitor C4 and the diac 49 which is a bilateral triggering device. These circuit elements provide a starting pulse to the transistor Q2 which is initially turned "on".

The bridge rectifier 12, through resistor R3, charges the capacitor C4 positively at its junction 50 with resistor R3. When this positive charge reaches the voltage breakdown point of the bilateral triggering diac 49, a positive pulse is applied through the diac 49 to the base 46 of the transistor Q2. This starts the oscillations of the halfbridge oscillator circuit.

The transistor Q2 is held "on" for the first half cycle of oscillation by the voltage induced with the proper polarity in the secondary winding L2 of the base driving transformer T1. During the time that Q2 is turned on, the voltage impressed on the primary L5 of the power transference transformer T2 is almost half of the output DC voltage from the bridge rectifier 12. This voltage feeds power to the load, the neon lamp 1, through the secondary winding L6. Sufficient power is provided to the feedback winding L4 to supply energy through the base driving transformer T1 to keep the transistor Q2 on and in saturation at a current level equal to the secondary load lamp current as reflected into the primary L5.

The transistor Q2 is initially supplied with current by the full wave rectifier 12 and capacitor filter C1. There is an electron flow from the collector 27 of transistor Q2 of the lines 52 and 34 leading to the primary L5 of the power transference transformer T2. Electron flow is through the primary winding L5 from end 9 to end 10 and through line 36 to the tap 42 between capacitors C2 and C3. From there the electron flow is through the capacitor C3 to the line 54 and then to the emitter 32 of transistor Q2 through line 29. At the same time an opposite voltage induced in L1 during the Q2 "on" time hold Q1 off, in this this condition there is an electron flow from line 34 and from the end 2 to the end 1 in the winding L1 of the pulse generator base driving transformer T1 to provide a reverse bias to the transistor Q1.

The voltage at the collector 27 of the transistor Q2 is a square wave pulse. The current flowing from collector 27 of the transistor Q2 is held on the blanace of the first half cycle by the positive voltage induced in the secondary winding L2 of the pulse generator base driving transformer T1 by transformer coupling to the primary L5, and feedback winding L4 on the T2 transformer.

The dot notation on the windings of the transformer T1 and T2 indicates a common polarity. That is, if in one winding the dotted end is at any time, for example, positive relative to the non-dotted end, the dotted ends of all of others windings are simultaneously positive relative to their non-dotted ends. Conversely, when any dotted end is negative relative to the non-dotted end of a winding, all of the other dotted ends of the other windings are simultaneously negative with respect to their own non-dotted ends.

If transistor Q2 is on, it is in saturation and the non-dotted end 6 of winding L2 is positive relative to the dotted end 5. By observing the dot convention of winding L2 it is evident that the Q2 base end 6 is positive with respect to the end 5 feeding resistor R6 and has the correct polarity to turn transistor Q2 on. The value of resistor R6 is chosen small enough to saturate transistor Q2 at its maximum gain and maximum load current.

Observing the dot notation depicted in FIG. 1, it is apparent that the base ends 6 and 1 of secondary windings L2 and L1, respectively, of the pulse generator base driving transformer T1, are always of opposite polarity. Therefore, as long as transistor Q2 is driven "on" by the induced voltage from the primary L3 of pulse generator base driving transformer T1, transistor Q1 is held "off". The contrary is also true.

Transistor Q2 remains on as long as there is a voltage induced in winding L2 by coupling to the primary L3 of the pulse generator base driving transformer T1. This "on" time is fixed by transformer T1 and the feedback voltage from the winding L4 by the fundamental magnetic relationships:

$$V_{L3}=N_pA_c(dB/dT)$$

$V_{L3}$ is the instantaneous primary voltage of the base driving transformer T1 in volts. $N_p$ is the number of primary turns of transformer T1. $A_c$ is the cross-sectional core area of transformer T1 in square centimeters. dB/dT is the instantaneous rate of change of magnetic flux density in gauss per second.

Figure 9:
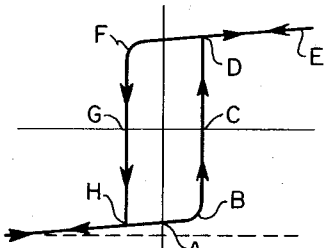
FIG. 9 illustrates the hysteresis loop of the pulse generator base driving transformer in the embodiment of the invention depicted in FIG. 1 and FIG. 10.

As long as transistor Q2 is in saturation, there is a constant voltage across the primary winding L3 of transformer T1 and the fundamental magnetic relationship dictates a constant dB/dT. With reference to FIG. 9, if the transformer core magnetic flux commences at point B, which is minus $B_{max}$, on the hysteresis loop, it moves linearly up in flux density along the flux path through point C at a rate given by dB/dT. When it reaches point D at $+B_{max}$ there can be no further dB/dT. Therefore, there can be no voltage across winding L3 and, as a result, no voltage across the secondary winding L2 of the transformer T1. This is simply another way of stating that at $+B_{max}$ the slope of the hysteresis loop or core permeability, and hence, the transformer T1 primary impedance have fallen to zero. The voltage across the primary L3 of transformer T1 thus falls to zero and the collector 27 of transistor Q2 is forced up toward source power voltage. Since the voltage across the primary L3 collapses, so does the voltage across the secondary L2. Now, as the voltage across all collector and base windings collapses to zero, the current form winding L2 through resistor R6, which had been directed into the base 46 of transistor Q2, is partially diverted into transistor Q1. thereby turning transistor Q1 partially on. Current in transistor Q1, because of the direction of the secondary winding L1, represents negative coercive force. The core operating point of the transformer T1 moves on the hysteresis loop of FIG. 9, and as current tends to increase in the negative coercive force direction, the core is again in a region of high permeability, indicated at point F in FIG. 9. Voltage can then be sustained across the primary winding L1 of transformer T1 with end 4 thereof negative.

With a high impedance in the collector 30 of transistor Q1, the voltage potential in collector 30 starts to fall as current increases. Also, a voltage starts to appear across the primary L5 of the power transference transformer T2. As a result of the transformer action of pulse generator base driving transformer T1, a voltage also appears across secondary winding L1 as well. This provides additional drive to the base 44 of transistor Q1 beyond that from resistor R5. As a result, the collector 30 of transistor Q1 is driven negative even more rapidly. This process continues regeneratively until the collector 30 of transistor Q1 is in saturation. At this time, flux moves along the path of the hysteresis loop in FIG. 9, through point G to point H. At $-B_{max}$ the drive to the base of transistor Q1 collapses as the core of the transformer T1 saturates in the negative direction. The same flip-over to partially turn transistor Q2 "on" occurs, followed by a full, regenerative turn-on which again saturates the transistor Q2. The core of transformer T1 again moves up the hysteresis loop path. This process continues with the transformer T1 moving cyclically over its entire hysteresis loop from $-B_{max}$ to $+B_{max}$ on one-half cycle, then down from $+B_{max}$ to $-B_{max}$ on the next, as depicted in FIG. 9.

Figure 2:
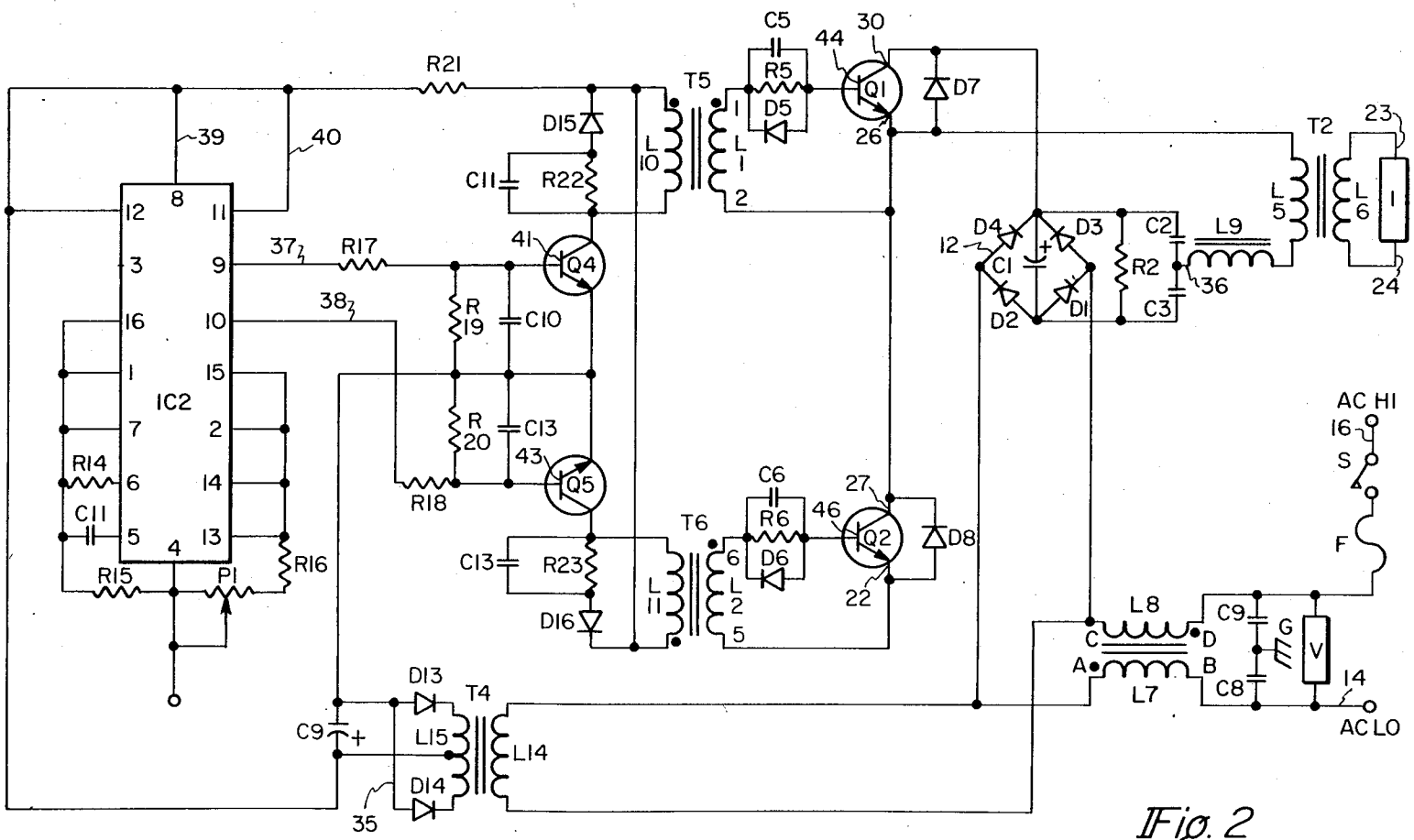
FIG. 2 is a schematic diagram of the electronic transformer system showing a second embodiment of the invention, with the capability to correct the power factor.

The output circuit configuration of FIG. 1 and FIG. 2 has the advantage of reducing the applied voltage across the inverter transistors Q1 and Q2 from two times the power source voltage on the direct current output of the rectifier 12 to a value equal to the output voltage of the rectifier. This is a half bridge converter, which replaces two of the inverter transistors with the two capacitors C2 and C3 which are coupled across the output of the full wave rectifier 12 with the primary L5 of the leakage reactance power transference transformer T2 fed from the tap 42 between capacitors C2 and C3. The use of the capacitors C2 and C3 in place of a pair of inverter transistors constitutes a more economical arrangement as compared to the bridge converters. The primary L5 of the power transference transformer T2 is fed effectively from capacitors C2 and C3. When transistor Q1 is turned on, current flows through the primary L5 of transformer T2 into the junction 42 of the capacitors C2 and C3 and replenishes the charge lost by both capacitors in the half cycle when transistor Q2 was on and drew current out of the junction 42 of the capacitors C2 and C3.

The resistor R2 connected across the output of the DC power supply has the function to discharge the capacitors C1, C2 and C3 when the electronic transformer system is disconnected from the public utility lines of alternating current. This meets the standard for safety of the Underwriters Laboratories (U.L.) which requires that a capacitor rated more than 0.06 microfarad shall be equipped with a positive means for draining the stored charged so that the difference in potential between the capacitor terminals will be 50 volts or less within 1 minute after the capacitor is disconnected from the source of supply.

The electronic transformer system of FIG. 1 has a circuit 11 to stop the oscillation when the secondary L6 of the power transference transformer T2 is without load or in short-circuit condition. When this circuit 11 stops the oscillation of the half-bridge inverter, there is no more voltage in the primary L5 of transformer T2 and, as a consequence, the voltage in the secondary L6 drops to zero.

This circuit 11 to stop the oscillation of the halfbridge inverter employs a step-down low power transformer T3, which has a primary L9 for receiving alternating current power as an input on AC lines 14 and 16, and has a secondary L10 providing low volage alternating current power as an output, to feed a half wave rectifier circuit 13. The half wave rectifying circuit 13 provides direct current low voltage power as an output to the circuit to stop the oscillation 11. The half wave rectifier has a diode D9, and a filter capacitor C9.

The circuit to stop the oscillation uses a resistor R4 to sense the input current on the AC line input 16, then the drop voltage across R4 is rectified and filtered by the diode D10 and capacitor C9 to get a direct current voltage proportional to the current input in the AC line 16. The negative of this voltage, through diode D11 is applied to pins 2 and 6 of the integrated circuit IC-1, which is a comparator voltage device, and the positive to pins 3 and 5 of the integrated circuit IC-1. The resistors R9 and R10 are a divider voltage network, and both have the same value, as a consequence, the midpoint 15 between them applies to pins 3 and 5 of the IC-1 a voltage equal to the half voltage of the power supply.

The base 19 of transistor Q4 is coupled, through line 18, to pins 1,7 of the voltage comparator IC-1. When the voltage in pins 2,6 is greater than the voltage in pins 3,5, the output of the voltage comparator device IC-1, in pins 1,7 is high, thus driven on the transistor Q4. The emitterbase circuit of transistor Q3, is connected to the output of transistor Q4 through the lines X and Y, and when the transistor Q4 is "on", drives the transistor Q3 into conduction. In this condition there is continuity in the base circuit of Q1, and thus, the half-bridge inverter can oscillate.

When the voltage in pins 2,6 is lower than the voltage in pins 3,5, the output voltage of the voltage comparator IC-1, in pins 1,7 is zero. As a consequence, transistor Q4 has no bias, and it is off; likewise transistor Q3 has no bias, and also is off. In this condition, the base circuit of transistor Q1 is open and the half-bridge inverter cannot oscillate. As a consequence, the secondary L6 of the power transference transformer will be without voltage.

When the output secondary L6 of the transformer T2 is without load to it is in short-circuit condition, the consumption of the whole circuit drops drastically, thus lowering the input current in AC line 16, and also the voltage across R4. If we set the movable arm of the variable resistor R8 in a position so that, at full load, the voltage in pins 2,6 of IC-1 is slightly higher than the voltage in pins 3,5 by the process above described the half-bridge inverter will oscillate and high voltage will be present in the output secondary L6 of the transformer T2. If the output secondary L6 is without load or is in a short-circuit condition, the voltage across the resistor R4 decreases, and the voltage in pins 2,6 of the voltage comparator IC-1 becomes lower than the voltage in pins 3,5 of IC-1. In this condition the output in pins 1,7 of IC-1 will be zero, turning transistors Q4 and Q3 off, interrupting the base circuit of transistor Q1 and stopping the oscillation. As a consequence, there will be no output voltage in the secondary winding L6 of the power transference transformer T2.

Figure 6:
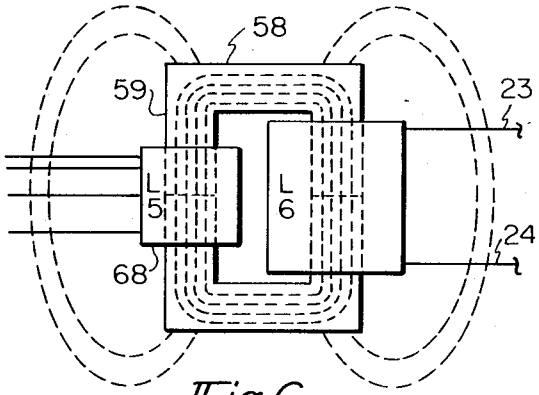
FIG. 6 is a diagrammatic view illustrating the power transference transformer employed in the electronic transformer system of FIG. 1, FIG. 2, and FIG. 10.

Because the neon lamp 1 requires a very high starting voltage, the ballast impedance required to stabilize the negative impedance of this type of lamp is achieved with a uniquely designed leakage reactance power transference transformer T2. The ballast impedance is incorporated in the design of the transformer T2 to deliberately introduce leakage reactance, as illustrated in FIG. 6. Such a transformer is known as a "stray-field" or "leakage reactance" transformer.

In a power transformer, the voltage and current taken by a load connected to the secondary winding is transformed or reflected into corresponding volts and amperes which have to be supplied to the primary winding. This transfer of energy from one winding to another can simply be considered as taking place through the magnetic field which links the two windings. In a conventional power transformer, the mutual magnetic field which links both windings must be kept as strong as possible so that a maximum energy is transferred. For this reason, a core is typically provided to concentrate and guide the magnetic flux, and the two windings are placed close together so that the same magnetic flux links both.

In the unique design of the power trnasference transformer T2 mutual magnetic flux linking the primary and secondary windings is deliberately reduced, and only a limited amount of energy is allowed to be transferred to the load (the neon lamp 1). In order to reduce the mutual flux and increase the leakage flux, the transformer T2 is provided with a core 58 having two limbs. Thus the transformer core 58 of FIG. 6 is constructed in a generally rectangular shape having linear limbs 59 and 60.

Figure 5:
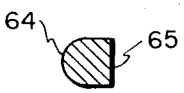
FIG. 5 is a view taken along lines A—A of FIG. 4.
Figure 4:
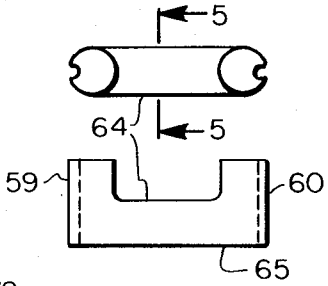
FIG. 4 is an elevational view showing one of the two mating components of the power transference transformer core.

The core 58 is formed from two U-shaped sections 64, depicted in FIGS. 4 and 5. Each of the sections 64 has a back 65 and a pair of legs 59 and 60 upstanding therefrom. Each of the core sections 64 is of circular cross-section, as depicted in FIG. 5. It should be understood that the core cross-section can be square, rectangular or any other shape. The feedback winding L4 is wound in the same leg 59 as the primary winding L5, and the legs 59 and 60 of the two core sections 64 are inserted from opposite directions into the hollow interiors of the bobbins 68 and 70 of the primary and secondary windings L5 and L6, respectively, to complete the rectangular, two-limbed core 58. As illustrated in FIG. 6, the primary and secondary windings L5 and L6, respectively, are mounted on two separate and different limbs 59 and 60 of the core 58.

The field 72 of the leakage flux reactance which is created about the primary winding L5 exerts only a limited effect on the secondary winding L6. The internal magnetic lines of flux within the transformer core 58 are as indicated at 74.

The field 72 of the leakage flux reactance which is created about the primary winding L5 exerts only a limited effect on the secondary winding L6. The interal magnetic lines of flux within the transformer core 58 are indicated at 74.

The secondary winding L6 has a high voltage, as is required by neon lamps. The voltage induced in the secondary winding L6 is between 5,000 volts and 15,000 volts, depending upon the length and diameter of the neon lamp 1. In order to obtain this high voltage, a great many turns are necessary to form the secondary L6. The large number of turns in the secondary L6 results in two problems. The high potential difference between layers of turns in the secondary L6 requires a very good insulation between layers to avoid dielectric breakdown. The interpositioning of such layers in the secondary of a conventional neon lamp transformer results in a transformer having an excessively large size. The other problem with the design of conventional neon lamp transformers is the effect of stray capacitance between the windings and layers of windings in the secondary. Such stray capacitance produces power loss.

Figure 3:
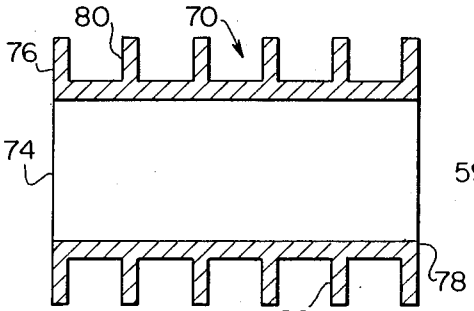
FIG. 3 is a cross-sectional view of the wound bobbin of the secondary of the power transference transformer T2 of FIG. 1, FIG. 2, and FIG. 10.

Both the foregoing problems have been overcome with the design of the leakage reactance power transference transformer T2 in the electronic transformer system of FIGS. 1 and 2. The construction of the secondary L6 of the transformer T2 is illustrated in FIG. 3. The secondary L6 includes a bobbin 70. The bobbin is a molded non-conductive structure, preferably formed of a dielectric plastic. The bobbin 70 has a cylindrical inner core hole 74 and annular end plates 76 and 78. The bobbin 70 also has annular partitions 80 spaced periodically and extending radially outwardly from the core hole 74 between the end plates 76 and 78. The insulated magnet wire is wound in loops on the bobbin 70 so that the secondary L6 is divided into annular sections which are longitudinally separated by the dielectric partitions 80, as illustrated in FIG. 3. In the embodiment depicted, the secondary L6 is divided into 5 longitudinally separated sections. This has the result of reducing the insulation requirement between layers of turns on the bobbin 70. In the output secondary winding L6, the spatial separation between very large voltages in quite large compared to conventionally wound transformers.

While the transformer windings are generally considered merely as large inductances, they also contain capacitance distributed throughout the windings in different ways, depending upon the type of coils and the arrangement of the windings. At low operating frequencies, such at the 60 hertz frequency of public utility lines, the effect of the stray capacitance between turns and layers of individual coils is negligible. As a result, the windings act as simple, concentrated inductances giving uniformly distributed voltage. However, when the windings are subjected to a sudden impact of high voltage and high frequency, the effect of stray capacitance in determining the voltage distribution becomes quite important. These capacitances are relatively unimportant at low frequencies. However, at high frequencies the capacitances have very low impedance, or even become virtually short circuits when subjected to high frequency waves or to steep fronted pulses, as occur with the square wave form of an electronic inverter. Moreover, at high frequencies, conditions of resonance may be reached for various combinations of inductances and capacitances.

The effect of stray capacitances may be explained with greater clairty by first considering the effect of an alternating current voltage impressed upon an inductance and a capacitance in parallel. With a constantly applied voltage the current taken by the capacitance is directly proportional to the frequency, while the current taken by the inductance is inversely proportional to the frequency. The particular frequency at which these two currents are equal is termed the resonant frequency for such a parallel combination. At the resonant frequency, the currents are equal and opposite. The combination therefore draws no resultant current from an external circuit, no matter how high the voltage may be. Such a parallel combination, therefore, acts like an open circuit at the resonant frequency. As is well known, such a parallel combination of an inductance and a capacitance acts, with respect to an external circuit, like a capacitance at frequencies above the resonant frequency and like an inductance at frequencies below the resonant frequency.

It is also helpful to consider two separate parallel combinations of an inductance and a capacitance in which the individual combinations are connected in series with each other, where the two combinations have different resonant frequencies. The results at frequencies between the resonant frequencies, so far as the voltage across the individual combinations and the current in the external circuit are concerned, are the same as with a single inductance and a single capacitance in series. In the context of the present invention, the external circuit should be considered to be the inverter, because of the impedance reflected onto the primary L5 by the secondary L6 of the power transference transformer T2.

If an alternating current voltage is impressed across an inductance and a capacitance in series, the same current flows through both due to the series connection, but the voltages across the inductance and capacitance are in opposition to each other with the applied voltage being the resultant of these two individual voltages. With a constant value of current in the series circuit, the voltage across the inductance is proportional to the frequency, while the voltage across the capacitance is inversely proportional to the frequency. The resonant frequency is the frequency at which these two voltages are equal.

Except for the efects of the losses in the series circuit, the voltage across the inductance and capacitance would be infinite, even though a finite voltage were applied across the combination. As a result, at resonant frequency the combination acts as a short circuit. At frequencies lower than resonance, the voltage across the capacitance will be greater than that across the inductance. At frequencies higher than resonance, the voltage across the inductance will be greater than that across the capacitance. The combination will therefore act like a capacitance at frequencies below resonant frequency and like an inductance at frequencies above resonant frequency.

The effects of a sudden application of voltage to typical combinations of inductances and capacitances should now be considered. In the simple case of a pure capacitance only, the current at the first instant is limited only by the characteristics of the inverter circuit. Due to the inductance of this circuit, the current cannot instantly build up in it. Therefore, the voltage across the capacitance will be zero at the first instant. As the capacitor is charged, the voltage will build up to the rate of value of the capacitor and the current will cease to flow. During the first instant, therefore, the capacitor acts as a short circuit, but changes to act like an open circuit once it is fully charged. The response of a pure inductance to a sudden application of voltage is the reverse of that exhibited by a capacitor.

With an inductance and capacitance connected in parallel, the combination acts as a short circuit at the first instant of impact of the exciting electric wave due to the presence of the capacitor. Finally, it also acts as a short circuit due to the presence of the inductor.

With an inductance and capacitance in series, the combination acts wholly as an open circuit at the first instant because current cannot flow through the inductor. The combination also acts wholly as an open circuit once the capacitor fully charges because current cannot flow through the capacitor. At the first instant the total voltage is applied across the inductor, while finally the total voltage acts entirely across the capacitor. During the interval between the first instant and the final condition a voltage oscillation occurs with a maximum voltage across the inductance equal to the applied voltage, and a maximum voltage across the capacitance equal to twice the applied voltage.

In a conventional neon lamp transformer capacitance and inductance are distributed as shown in FIGS. *7a* and *7b*. The capacitances 82 between portions of the same winding 84 act in parallel with the inductances of the same portions. There are, therefore, as illustrated in FIG. *7b*, various parallel combinations of inductances 86 and capacitances 87 in series with various other similar combinations. This provides the opportunities for resonance and excessive internal voltages at various points inside the windings. These resonances and excessive internal voltages occur internally at different frequencies.

A consideration of the foregoing explanations shows that it is possible to obtain high transient voltages between turns as a result of the impact voltage due principally to the front edge of the square waveform in an inverter. This can result in serious trouble and failures in a conventional neon lamp transformer system due to the severity of the dielectric stresses on the insulation between turns. These dielectric stresses are determined by the frequency and steepness of the front edge of the waveform, the amplitude of the wave, and the ratios between various capacitances of the windings.

Figure 8B:
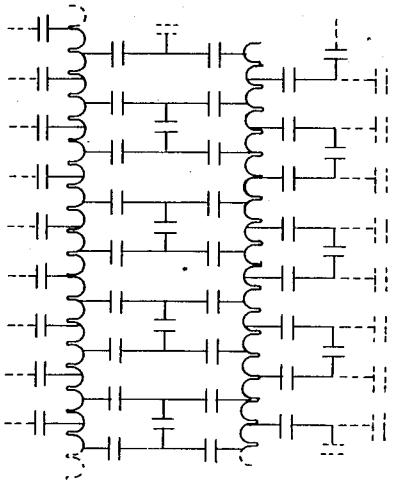
FIG. 8*b* is an exemplary equivalent circuit showing he stray capacitance and inductance in a multi-section bobbin in a power transference transformer according to the invention.
Figure 8A:
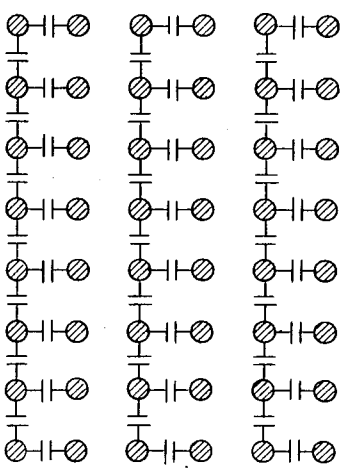
FIG. 8*a* is an exemplary equivalent lay-out or pictorial image showing the stray capacitance between turns, layers and windings in a multi-section bobbin in a power transference transformer according to the invention.
Figure 7B:
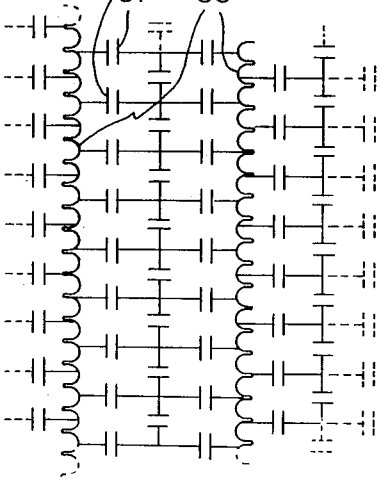
FIG. 7*b* is an exemplary equivalent circuit showing the stray capacitance and inductance between layers, turns and windings in a single section bobbin of a prior art neon transformer.
Figure 7A:
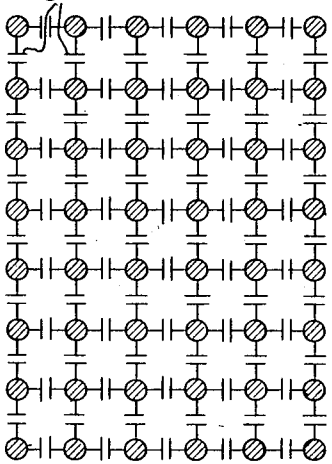
FIG. 7*a* is an exemplary equivalent lay-out or pictorial image illustrating stray capacitance between layers, turns and windings in a single section bobbin of a prior art neon transformer.

The situation is especially serious at resonant conditions. Moreover, the possibility of obtaining resonant conditions with a square wave is quite probable due to the high harmonic components of this type of waveform. With the sectionalized winding of a multiple section bobbin, as shown in FIG. 3, the diagram of the stray capacitance takes the form of FIGS. 8*a* and 8*b*, rather than that of FIGS. *7a* and *7b*. As is well known, the resonant frequency is inversely proportional to the square root of the capacitance. Where the capacitance is smaller, the frequency of the resonant conditions is higher. As a consequence, the resonant conditions will be present at higher harmonics where amplitudes of the components waveform are greatly reduced.

Another disadvantage of high stray capacitances is that the inverter sees a reflected capacitance as a load. As is known, this is the worst condition for an inverter. A capacitive load changes the current waveform through the primary of the power transference transformer, but the voltage waveform remains unaffected. The voltage waveform remains a square wave, but current spikes appear in the primary each time the transistors of the inverter are switched to begin to conduct. When an inverter transistor begins to conduct, it supplies power to reverse charge the capacitance through a very low impedance. With the voltage constant, the current rises to high levels until the capacitance, as it charges, begins to represent a rising impedance in the load. Until the capacitance charge rises there is very little impedance to slow the on-rush of current in the transistor, other than the slight resistance in the transformer wire and the saturation resistance of the transistor. This situation is repeated each half cycle as the waveform changes its polarity. Because the current level rises to a high value as each transistor begins to conduct, the $I^2R$ losses in the inverter rise, and the efficiency decreases.

The eventual result of such current spikes on the operation of the inverter transistors may well be the destruction of the transistors. The high peak currents cause the transistor switches to run out of driving power, and to pull out of saturation into a condition of high dissipation, which can cause them to burn out. The energy loss per cycle in the form of heat in each transistor is $\frac{1}{2} C_s(E_o)^2$. $C_s$ is the stray capacitance and $E_o$ is the output voltage of the secondary of the transformer T2. It can be seen, therefore, that it is very important to reduce the stray capacitance of the power transference transformer.

The Federal Communication Commission (FCC) requires that in electronic devices conducted emissions on the alternating current lines between 10 kilohertz and 30 megahertz must be at a very low level to avoid interference on radios and communication equipment. Due to the large number of harmonic components in electronic inverters, it is often necessary to provide low pass filters in order to meet the FCC requirements. In the embodiment of FIG. 1 and 2, a pair of inductors L7 and L8 is wound bifilarly and in opposite direction on a common core to avoid core saturation, as indicated at 88. The inductor L7 is positioned in the alternating current line 14 while the inductor L8 is positioned in the alternating current line 16. The input current on the alternating current lines 14 and 16 flows through these two inductors L7 and L8 to feed the halfbridge inverter circuit. The input current is sufficient to saturate the core 88 which would normally cause the inductance to disappear. The current in the bifilar windings of inductance L7 and L8 flows in opposite directions to generate two magnetic fields. Both magnetic fields have the same magnitude, but are in opposite directions, thus cancelling each other out. This avoids saturation of the core 88.

As is well known, the impedance of an inductance is directly proportional to the frequency. The inductance impedance is given by the formula $X_L=2\pi fL$, where $X_L$ is the impedance of the inductance, f is the frequency, and L is the value of the inductance. With the arrangement of inductors L7 and L8, there is a very high impedance in the return to the alternating current line to frequencies in the range between 10 kiloherz and 30 megahertz. Harmonic components in this range are therefore very strongly attenuated.

A pair of capacitors C8 and C9 is coupled across the alternating current lines 14 and 16 with a coupling to ground indicated at 90 between the capacitors C8 and C9. The function of the capacitors C8 and C9 is to eliminate almost completely any harmonic interference in the range between 10 kilohertz and 30 megahertz.

The impedance of a capacitance is inversely proportional to the frequency as is shown by the formula $X_c=1/(2\pi fC)$ where $X_c$ is the capacitive impedance, f is the frequency, and C is the value of the capacitance. With the interposition of the capacitors C8 and C9 between the alternating current input lines 14 and 16 and its midpoint 90 connected to ground, the attentuated harmonic components reaching the end of the inductors L7 and L8 going toward the alternating current supply find a low impedance pass through the capacitors C8 and C9. Because the junction of these two capacitors is grounded, the harmonic components are shunted to ground and therefore almost complete1y eliminated.

The varactor V in FIGS. 1 and 2 is a surge protector device that is included to protect the circuit against transients on the alternating current lines 14 and 16. The transformer system is also protected by a fuse 92 in the hot alternating current line 16.

Because of the high leakage reactance of this type of transformer, and the many turns in the secondary L6 of the transformer T2, the primary L5 sees reflected an inductive load.

Let us examine the current waveform in the primary L5 of the power transference transformer T2, under this condition. Consider the circuit of FIG. 1, where the inductor L9 in the line 36 was not included. The phase relation of the voltage waveform across the primary of T2 is compared with the current waveform through the primary of T2 in FIG. 11. When the half-bridge inverter must operate into an inductive resistive load, as in the present situation, the power that the load attempts to feed back into transformer T2 affects the current waveform in the primary L5. Transistor Q1 should begin conduction at the 0° conduction angle, but the inductive resistive load is attempting to force a reverse current flow through the transistor. Because all transistors are unidirectional devices, the transistor blocks the required reverse current. This interruption of the current flow from the load, when it is at is maximum point, causes a reverse voltage spike to build up on the primary L5 of T2, and this spike rises until it short circuits the transistor and causes it to fail. In theory, the spike could rise to an infinite voltage and, therefore, the voltage rating of the transistor is of no consequence; it still will fail. When transistor Q2 attempts to conduct, at the 180° conduction anle, it faces the same failure.

Figure 11:
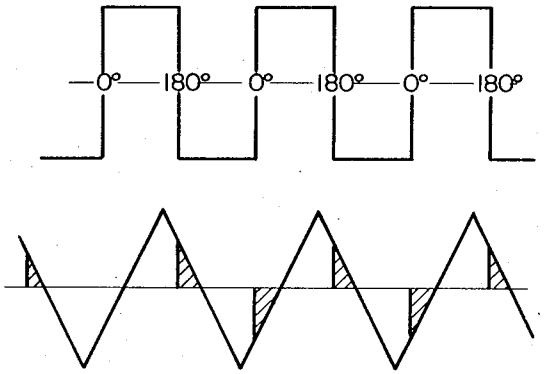
FIG. 11 shows the voltage waveform across the primary of T2 transformer compared with the current waveform through the same primary.
Figure 12:
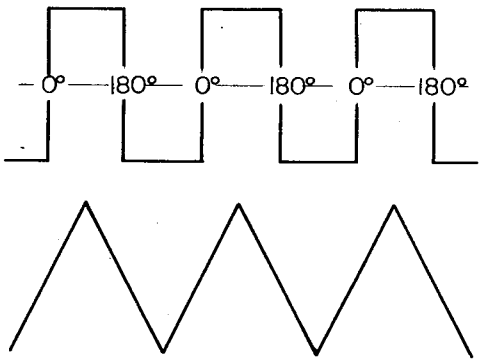
FIG. 12 shows the voltage and current waveforms when the choke L9 is included.

The energy that the inductive load must feed back into the inverter is represented in FIG. 11 by the shaded areas in the current waveform. The inductor L9 in the line 36 is designated to handle this energy. The inductor L9 in FIGS. 1 and 2 (commonly called the feed choke) is an inductance of sufficient value to maintain the current flow through the circuit under all conditions. The current flow through the feed choke L9, once established, tends to resist any change in current level. The current through the transistor, and through the primary L5 of transformer T2, is approximate to a square wave and it is almost in phase, as depicted in FIG. 12. In this manner, the inverter can deliver power to the load, then receive power back from the load, without passing it back through the inverter, avoiding the spikes in the transistors.

If the line 20 or 25, is cut indiscriminately and we take two derivations 21 and 22 or 31 and 33, respectively, we can add an external flasher to get the flashing effect. In this case, because of the low current in the base circuit of transistors, the flasher must handle only a low current, in the order of milliamps, overcoming the problem of conventional transformers operated with conventional flashers.

The embodiment of FIG. 2 illustrates an electronic transformer system that is a variation of that of FIG. 1, with some important advantages. The output stage formed by transistors inverter Q1 and Q2, capacitors C2 and C3, full wave rectifier D1-D2-D3-D4, and transformer T2, is exactly the same as that of the half-bridge inverter configuration in FIG. 1.

The main difference is in the base drive circuit. Whereas the circuit of FIG. 1 is a self-oscillating circuit (where the oscillations are given by the core saturation of transformer T1), in the circuit of FIG. 2 the base drive circuit, which gives the signals for the oscillations, is built-up around the integrated circuit IC-2, which is a regulating pulse width modulator.

The base drive circuit of the electronic transformer system of FIG. 2 employs a step-down low power transformer T4, which has a primary winding L14 for receiving alternating current power as an input on AC lines 14 and 16, and has a center tapped secondary winding L15 for giving low voltage alternating current power as an output, to feed a full wave rectifying circuit 35. The full wave rectifying circuit 35 provides direct current low voltage power as an output to the base drive circuit. The full wave rectifier has two diodes D13 and D14, and a filter capacitor C9.

The IC-2 has all the functions required for a pulse width modulation control circuit, including a frequency adjustable oscillator and dead time control comparator. The oscillator frequency is programmed with an external capacitor C11 and an external resistor R14, coupled to pins 5 and 6 of IC-2, respectively. The oscillator clock frequency must be set at twice the required converter operating frequency.

The IC-2 outputs are two width-modulated, 180° out-of-phase control "switches". These switches are two n-p-n transistors that are alternately on and off for alternate half cycles of the fundamental frequency. Both emitters and collectors are brought out, thereby permitting the driving of either n-p-n or p-n-p transistors. The collectors of these transistors are the pins 8 and 11 of IC-2 and the emitters are the pins 9 and 10, respectively. The outputs of these two internal transistors of IC-2 are two width-modulated square waves, 180° out-of-phase.

The output signal of IC-2 is coupled to transistors Q4 and Q5 which function to amplify those signals. The emitter pin 9, through the line 37 and resistor R17 is coupled to the base 41 of transistor Q4, and the emitter pin 10, through the line 38 and resistor R18 is coupled to the base 43 of transistor Q5. Once amplified, these signals from the transistors Q4 and Q5 are applied to transformers T5 and T6. The function of these transformers is to couple the width-modulated square wave to the output stage of the electronic transformer system and insulate electrically the low voltage oscillator circuit from the high voltage inverter circuit.

The two series connected transistors Q1 and Q2 are driven in alternating sequence. The bases 44 and 46 of the transistors Q1 and Q2, respectively, are alternately biased by the 180° out-of-phase signals of secondary L12 and L13 of transformers T5 and T6, respectively.

In the embodiment depicted in FIG. 2, the base driving transformers T5 and T6 each have one secondary output winding, L1 and L2 respectively, connected in circuit between the emitter and the base of the associated transistor Q1 or Q2. A diode D5, a capacitor C5 and a resistor R5 are connected in parallel to the base 44 of the transistor Q1. The other ends of the capacitor C5, diode D5 and resistor R5 are are connected to one lead of the secondary winding L1, and the other lead of the secondary winding L2 is connected to the emitter 26 of transistor Q1. Similarly, a diode D6, a capacitor C6 and a resistor R6 are connected in parrallel to to the base 46 of the transistor Q2 from one lead of the secondary winding L2 of the base driving transformer T6, and the emitter 22 of transistor Q2 is coupled to the other lead of the secondray winding L2.

From this point, the circuit of FIG. 2 works in the same way as the circuit in the depicted embodiment of FIG. 1.

One of the advantages of this configuration circuit is that it is possible to overcome the problem of simultaneous conduction. To avoid the problem of simultaneous conduction and possible destruction of power inverter transistors Q1 and Q2, it is desirable to have a minimum "dead time" or gap between the end of one pulse and the start of the next at the output points of IC-2, pins 9 and 10. This is done by choosing the proper value of resistors R15, R16 and the variable resistor P1.

Figure 13:
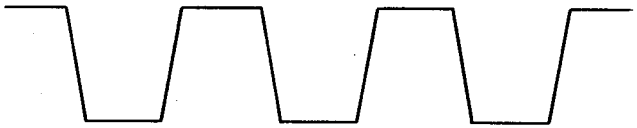
FIG. 13 shows the voltage waveform in the collector transistor Q1.
Figure 14:
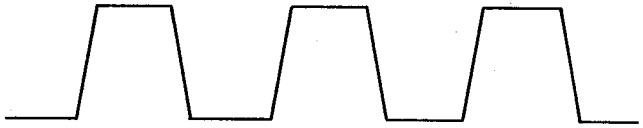
FIG. 14 shows the voltage waveform in the collector transistor Q2.
Figure 15:
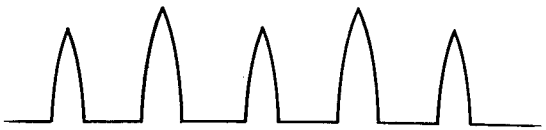
FIG. 15 illustrates the spikes of high power dissipation as a consequence of the overlap in the conduction time of transistors Q1 and Q2.

FIGS. 13 and 14 represent the voltage waveforms in the collectors of transistors Q1 and Q2 in the prior art of inverters, showing the overlap of high voltage and current at transition times (especially turn-off times) that can cause transistor failure. FIG. 15 illustrates the spikes of high power dissipation as a consequence of simultaneous conduction pulses resulting from the storage time in the off turning transistor; this was explained in the description of the embodiment of FIG. 1.

Figure 16:
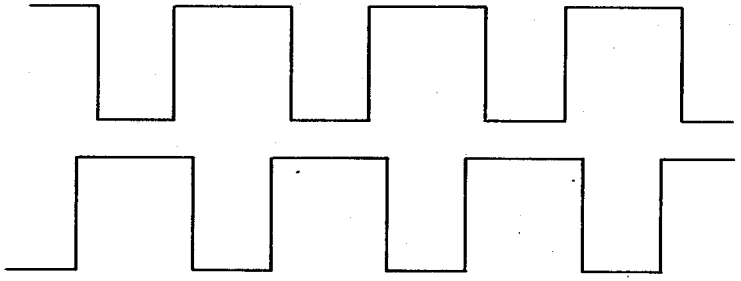
FIG. 16 illustrates the voltage waveforms in transistors Q1 and Q2 when the duty cycle is controlled.

By choosing the proper values of resistors R15, R16 and the variable resistor P1, we can control the duty cycle of the inverter to get the desirable "dead time" FIG. 16 illustrates the voltage waveforms in transistors Q1 and Q2 when the duty cycle is controlled, showing that the problem of simultaneous conduction is eliminated. The variable resistor P1 also permits a manual control of the duty cycle. With this characteristic, it is possible to control the intensity of light output of neon lamp 1. Another way to control the duty cycle and, therefore, the intensity of light output, is to apply a positive voltage in pin 4 of IC-2. This characteristic permits the control of light output by means of a computer. Also is possible to accomplish the flashing effect by means of positive voltage pulses applied to pin 4 of IC-2.

The inverter circuits used in the embodiments of FIGS. 1 and 2 include a rectifier bridge 12 which is coupled to an AC potential, lines 14 and 16, and to a load circuit. A capacitor C1 is connected in shunt with the rectifier. When the input voltage exceeds the voltage on the capacitor plus the voltage drop across two diodes, current flows into and charges the capacitor C1. This charging of the capacitor continues until the input potential reaches a maximum value and starts to decrease. Thereupon, charging of the capacitor ceases and a discharge through the load is effected.

The self-oscillating circuit of FIG. 1 must have a low ripple voltage in the output of the bridge rectifier 12. To reduce the ripple to a low value, compatible with the halfbride inverter of FIG. 1, requires a high capacitance in the capacitor C1. This capacitance reduces the current conduction period or angle, but is highly undesirable because it lowers the value of the power factor. This low power factor produces unduly large loads on the AC line. The circuit also has the disadvantage that large peak currents are drawn which greatly disrupt the AC line. Moreover, there will be large in-rush current to charge the capacitor C1 when the circuit is first turned on.

FIG. 15 shows a typical voltage and current waveform associated with this type of power supply. We can see in it the low duty cycle and the large peak current. Moreover, that waveform shows that it is composed of many harmonics, which yield electrical noise into the AC line, thus affecting the performance of much electronic equipment, especially communication and computer devices.

The problem of feeding neon lamp 1 with a voltage with high ripple could be solved by eliminating the capacitor C1 or reducing its capacitance. But it is not possible to do so practically. There is a relationship between the voltage of the power supply, the transistor bias and the oscillator frequency.

FIG. 14 shows a typical output waveform from a bridge rectifier. It is a sinoidal pulsating waveform, with a peak that is equal to $\sqrt{2}$ times the root means square (rms) of, 120, the AC input voltage from the utility public lines, which varies from zero to that peak value.

If the bias of the transistors is designed as a function of the peak value of this sinoidal pulsating waveform, the drive on the transistors will drop below the minimum required in the low sides of the waveform. If the bias of the transistors is designed as a function of some intermediate value, the transistors will be overdriven on the high side of the pulsating waveform, and as a consequence, this will result in a high power dissipation and transistor failure.

Moreover, because the voltage varies from zero to the peak value of the sinoidal pulsating waveform, according to the fundamental magnetic relationship, the frequency similarly will vary from zero to the corresponding frequency peak value.

The embodiment of FIG. 2 can be arranged to force the input line current to flow for most of the time during each half cycle so that the duty cycle of the current is maximized, thus overcoming the problems associated with low power factor.

With the embodiment of FIG. 2, achieving a high power factor is simple. Two completely independent circuits, each with its own power supply, are electrically insulated from each other. One is the base drive circuit 54, and the other is the inverter output circuit 55. The power consumption of the base drive circuit is less than 3% of the power consumption of the inverter output circuit 55. As a consequence, the base drive circuit has no significant effect on the overall power factor.

Figure 17:
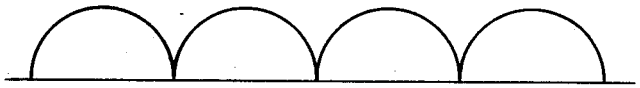
FIG. 17 shows a typical output waveform for a bridge rectifier.
Figure 18:
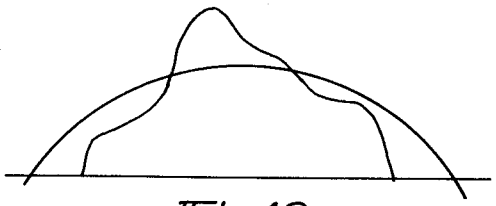
FIG. 18 illustrates a typical voltage and current input waveform associated with the embodiment of FIG. 2.

Capacitor C9 is designed as a filter to minimize the ripple in the DC output power of the base drive circuit in power supply 35. Thus, a constant voltage drives the bases of transistors Q1 and Q2. Furthermore, the frequency is constant and stable, as it is supplied by the integrated circuit IC-2. This condition allows reduction of capacitor C1 to a minimum value, extending the duty cycle of the AC input current to almost the entire cycle and reaching a power factor of 0.98. FIG. 17 shows a typical voltage and current waveform associated with the power supply of the embodiment of FIG. 1, which displays the low duty cycle and large peak current. FIG. 18 illustrates a typical voltage and current waveform associated with the embodiment of FIG. 2, with power factor corrected.

Figure 10:
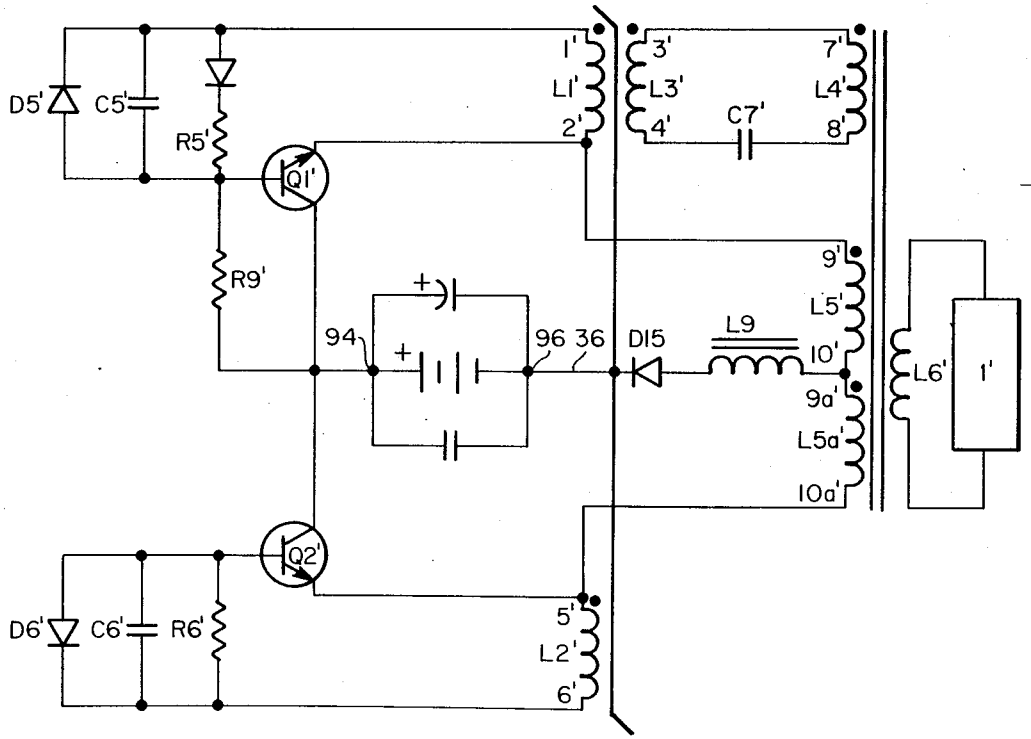
FIG. 10 is a schematic diagram of an electronic transformer system according to the invention operated from a direct current power source.

The embodiments of FIGS. 1 and 2 illustrate the electronic transformer system of this invention operated from commercially available alternating current power provided by public utilities. Commercial alternating current is provided to the full wave rectifier 12 which is coupled across the pair of alternating current lines 14 and 16. The rectifier 12 is coupled to supply power to the inverter circuit. However, the invention also operates where the direct current source is a battery, such as a conventional 12-volt DC motor vehicle battery. The embodiment of FIG. 10 illustrates an electronic transformer system which is designed to be powered by a 12-volt DC motor vehicle battery. The positive terminal 94 and the negative terminal 96 are connected to positive and negative terminals, respectively, of a motor vehicle battery. The counterphase oscillator circuit, in the embodiment of FIG. 10, employs a push-pull electronic inverter configuration inasmuch as the low voltage of the battery permits use of inexpensive transistors Q1' and Q2' without reducing the emitter to collector voltage. The basic principles of operation of the electronic transformer system of the embodiment of FIG. 10 are the same as described in conjunction with the transformer system of FIG. 1. Circuit elements in FIG. 1 which find corresponding structure in the embodiment of FIG. 10 are indicated by a primed notation in FIG. 10.

In the embodiment of FIG. 10, the secondary winding L6 of the power transference T2' is the same as that depicted in FIG. 3 previously explained. A diode D15 is coupled in line 36' to insure proper polarity of current flow in line 36'. The line 36' is connected to the center of the primary L5, rather than to one end of that primary, since the transistors Q1' and Q2' are coupled together in push-pull fashion, rather than in series as are the inverter transistors in FIG. 1. The opposite ends of the transformer primary L5' are respectively coupled to the emitters of transistors Q1' and Q2'.

A biasing resistor R9 is coupled between the base and collector of transistor Q1'.

Notwithstanding that the former description refers to specific models of the invention, it must be understood by all the experts in this subject that any modification in form or detail must be included within the spirit and reach of the present invention.

What is claimed is:

1. An inverter-oscillator means supplies AC voltage and current for starting and operating a neon lamp, of the type requiring a high starting voltage and a lower operating voltage and said inverter-oscillator means for generating high frequency AC voltage comprising switching means for generating a high frequency AC current and voltage and a leakage reactance power transference transformer means, said power transference transformer means responsive to said high frequency and voltage from said switching means, for applying said AC voltage and current to said neon lamp, with the secondary of said leakage reactance power transference transformer wound on a bobbin having a plurality of sections separated by dielectric partitions.

* * * * *